United States Patent [19]

Hartmannsgruber et al.

[11] 4,336,684

[45] Jun. 29, 1982

[54] DRIVING ASSEMBLY FOR RING SPINNING OR TWISTING MACHINE

[75] Inventors: Max Hartmannsgruber, Kirchheim; Horst Wolf, Albershausen, both of Fed. Rep. of Germany

[73] Assignee: Zinser Textilmaschinen GmbH, Ebersbach, Fed. Rep. of Germany

[21] Appl. No.: 132,770

[22] Filed: Mar. 24, 1980

[30] Foreign Application Priority Data

Mar. 23, 1979 [DE] Fed. Rep. of Germany ..... 2911378

[51] Int. Cl.[3] ..... D01H 1/20; D01H 1/22; D01H 1/24

[52] U.S. Cl. ..... 57/93; 57/94; 57/95; 57/100

[58] Field of Search ..... 57/92, 93, 94, 95, 96, 57/97, 100

[56] References Cited

U.S. PATENT DOCUMENTS 3,316,699 5/1967 Mattingly ..... 57/100 X
3,375,650 4/1968 Sagchomme et al. ..... 57/100 X
3,738,095 6/1973 Lohest ..... 51/100
3,768,244 10/1973 Yasutomi et al. ..... 57/95 X
3,936,998 2/1976 Wolf ..... 57/100

FOREIGN PATENT DOCUMENTS 1113378 5/1968 United Kingdom .

*Primary Examiner*—Donald Watkins
*Attorney, Agent, or Firm*—Karl F. Ross

[57] ABSTRACT

An assembly of motors designed to drive a ring rail, a bank of spindles and a plurality of draw or delivery rollers in a ring spinning or twisting machine is supplied with three-phase current of a frequency determined by the settings of digitally adjustable frequency selectors independently controlling respective solid state frequency-inverters assigned to the several motors or groups of motors. The selectors include frequency dividers in the output of a common and preferably also adjustable source of timing signals which may be a free-running oscillator or a pulse generator driven by one of the motors acting as a master.

9 Claims, 3 Drawing Figures

DRIVING ASSEMBLY FOR RING SPINNING OR TWISTING MACHINE

FIELD OF THE INVENTION

Our present invention relates to a driving assembly for the various components of textile equipment, more particularly to a group of motors serving for the rotation of the spindles and feed rollers and the reciprocation of a ring rail in a ring spinning or twisting machine.

BACKGROUND OF THE INVENTION

In conventional textile machines of this type there is generally provided a main motor which may be directly coupled with, say, a driven feed roller and drives the other components, whose operation is to be correlated with that of the feed roller, via respective mechanical speed changers. Any modification of the speed ratio in such a system requires a change of gears and thus entails a considerable delay.

It has already been proposed to use digitally adjustable solid-state frequency inverters for the drive of certain elements of textile machinery; see an article entitled "TEXTILE APPLICATIONS OF ADJUSTABLE-FREQUENCY DRIVES WITH DIGITAL RATIO CONTROL" by Edward H. Dinger, IEEE Transactions on Industry Applications, Vol. IA-8, No. 1, January/February 1972, pages 47–55. As far as we are aware, however, there have been no suggestions heretofore regarding the utilization of this technique for the solution of problems encountered in correlating the operations of the diverse components of a ring spinning or twisting machine.

OBJECT OF THE INVENTION

Thus, the object of our present invention is to provide simple, efficient and relatively inexpensive means for varying both the absolute and the relative speeds of roller and spindle rotation as well as ring-rail reciprocation in a textile machine of the type referred to, designed not only to facilitate quick changes in speed ratio even during operation but also to enable a smooth start-up and run-down of the entire equipment.

SUMMARY OF THE INVENTION

A textile machine to which our invention is applicable, whether it be of the ring-spinning or the ring-twisting type, includes at least one ring rail traversed by a bank of parallel spindles and feed means, such as draw or delivery rollers, for supplying filamentary material to the spindles through travelers on rail-supported rings in accordance with common practice. First, second and third motor means are respectively provided for the reciprocation of the ring rail along the spindle axis, for the rotation of the spindles about their axes and for driving the feed means; the second motor means may consist of a set of individual drive motors for the several spindles. Pursuant to our present invention, we provide first, second and third adjustable frequency-changing means, preferably solid-state inverters, respectively inserted between a common power supply and the first, second and third motor means, these frequency-changing means being respectively controlled by first, second and third frequency-selection means enabling independent variation of the frequency of an alternating (preferably three-phase) current fed to the associated motor means.

Pursuant to a more particular feature of our invention, the first, second and third frequency-selection means are provided with a common source of timing signals which advantageously is also adjustable to let an operator or possibly an automatic controller vary the speeds of all the components in a correlated manner, e.g. for starting and stopping the equipment. The source of timing signals may be a free-running oscillator but could also be a pulse generator driven by one of the motors involved which then acts as a master motor and whose own speed, determined by an independently adjustable frequency selector, thus controls the operating speeds of all other motors.

BRIEF DESCRIPTION OF THE DRAWING

The above and other features of our prsent invention will now be described in detail with reference to the accompanying drawing in which.

SPECIFIC DESCRIPTION

Figure 1:
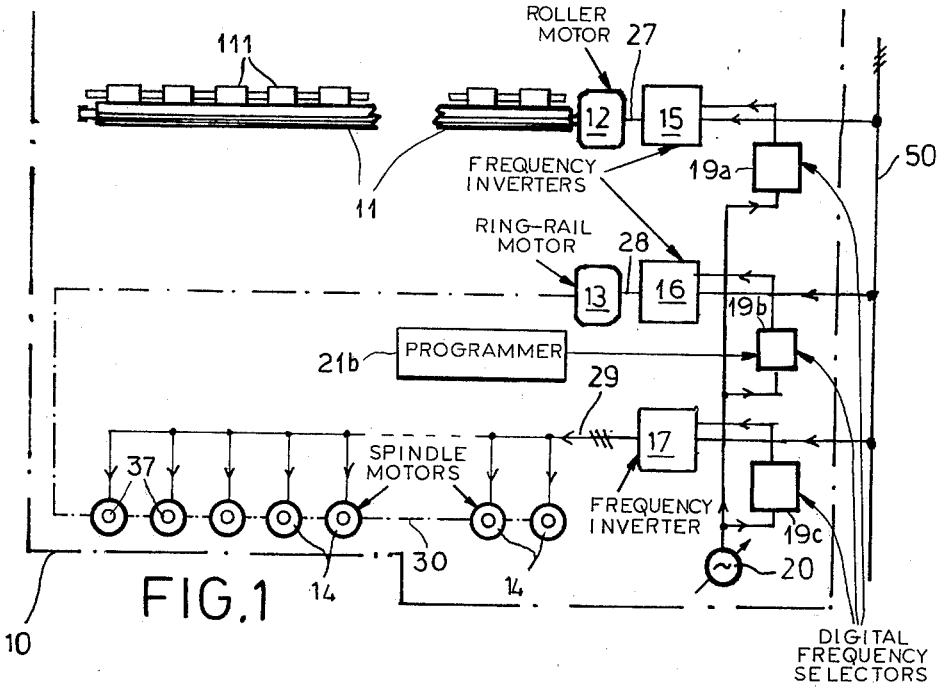
FIG. 1 is a diagrammatic view of the principal components of a ring twisting machine embodying our invention.

FIG. 1 shows a ring twisting machine 10, illustrated only in part, which comprises a long feed roller 11 coacting with a set of overlying, nondriven counterrollers 111 for delivering filaments to respective upright spindles 37 traversing a vertically reciprocable ring rail which has been indicated only schematically at 30. Roller assembly 11, 111 could be duplicated on the opposite side of the bank of spindles 37 in order to supply the spindles with additional threads to be entwined with those coming from the illustrated rollers. The feed roller 11 is driven by a motor 12 of the synchronous three-phase type, a similar motor 13 being used to reciprocate the ring rail 30 (e.g. in a manner more fully described hereinafter with reference to FIG. 3). With duplicated feed rollers as mentioned above, motor 12 can be coupled to the nonillustrated second driven roller via a gear transmission of speed ratio 1:1. Similarly, motor 13 could be used to drive a plurality of ring rails in unison. The spindles 37 are driven by individual motors 14 which, in the usual manner, can be temporarily deactivated in the case of a malfunction such as a thread rupture. In a practical embodiment there may be as many as 200 to 400 spindles 37 traversing the ring rail 30.

All these motors are energized from a common power line 50, here shown schematically to include three phase leads, via respective frequency inverters 15, 16 and 17 working into three-phase inputs 27, 28 and 29 of motors 12, 13 and 14, respectively. Inverters 15, 16 and 17 have output frequencies adjustable with the aid of respective frequency selectors **19*a*, 19*b* and 19*c* receiving timing signals from a common source here shown as a free-running oscillator 20** emitting a pulse train of adjustable cadence.

Figure 2:
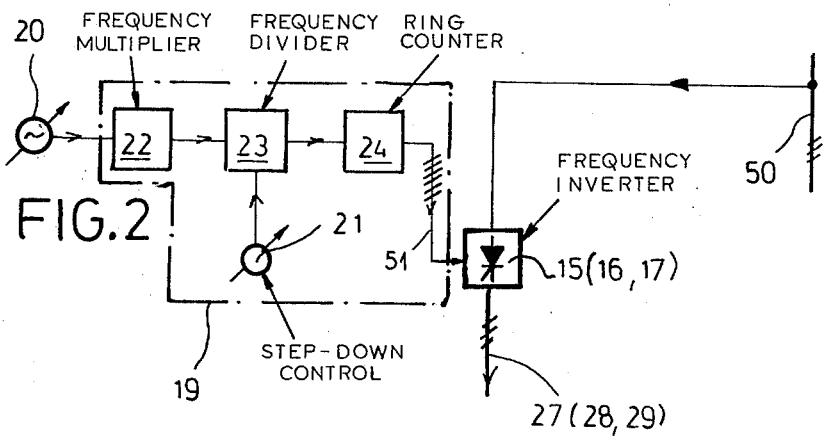
FIG. 2 is a block diagram of a digitally adjustable frequency selector used in the system of FIG. 1.

The frequency inverters 15–17 may be of the solid-state type described in the above-identified article by Edward H. Dinger, including a d-c link with positive and negative conductors which are sequentially connectable to the outgoing phase leads with the aid of three pairs of electronic switches, particularly thyristors, in a rhythm determined by the cadence of gating pulses obtained from the associated selector. The frequency selector 19 illustrated in FIG. 2, representative of any one of selectors 19*a*, 19*b* and 19*c* shown in FIG. 1, comprises a frequency multiplier 22 receiving the output of pulse generator 20 and working into a frequency divider 23 whose step-down ratio is adjustable by a digital control device 21 such as a thumbwheel as also described in the Dinger article. Pulses issuing from generator 20 could be delivered directly to divider 23, with omission of multiplier 22, if their cadence is sufficiently high. Especially with a motor-driven pulse generator (45) as described hereinafter with reference to FIG. 3, however, a frequency multiplication up to about 1000:1 will be useful. Frequency divider 23 may have a step-down ratio variable in unity increments between 100:1 and 10,000:1 for very fine speed control. Such a divider may comprise a pulse counter resetting itself upon reaching the maximum count chosen by control device 21, each return to zero being accompanied by the emission of one pulse to a ring counter 24 which distributes these pulses to the gates of the three pairs of thyristors included in the associated frequency inverter 15, 16 or 17 as schematically indicated in FIG. 2. Ring counter 24 may have six stages with respective output leads forming part of a multiple 51.

In the case of frequency selector 19*b*, FIG. 1, the control device 21 of FIG. 2 may be a programmer 21*b* which modifies the operating speed of motor 13, and thus the rate of displacement of ring rail 30, within a recurrent cycle of reciprocation as required for the buildup of a desired type of yarn package on each spindle 37. Thus, for example, the rail speed may vary (continuously or in steps) in one sense during an upstroke and in an opposite sense during the downstroke to produce a tapered yarn body or cop on a bobbin carried by each spindle. Programmer 21*b* may be linked mechanically or electrically with a gear or switch reversing the rail motion at the end of each stroke. Frequency selectors 19*a* and 19*c* may be manually settable.

While all the motors 12, 13 and 14 shown in FIG. 1 are preferably of the synchronous type, we may also use induction motors in those instances in which the maintenance of an exact speed ratio relative to the other components is not critical, e.g. in the case of spindle motors 14. In such an instance it is also possible to replace the digitally settable frequency inverter by an analog-type frequency changer, e.g. a rotary converter designed as an inductor with a three-phase stator energized by the power supply and a rotor driven by a d-c motor whose speed is continuously adjustable and which thus serves as the associated frequency selector. The output frequency available at the slip rings of the rotor can thus be linearly varied from zero up, allowing a gradual acceleration of the controlled motor or motors from standstill and return to the idle state.

Figure 3:
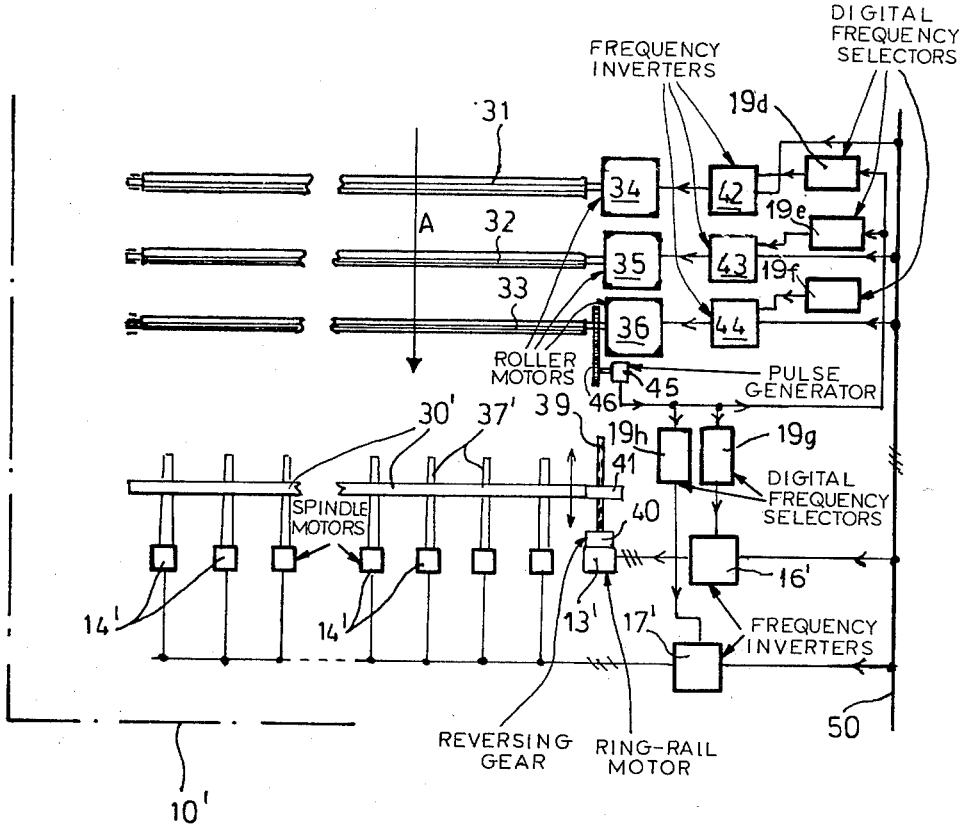
FIG. 3 is a view similar to FIG. 1, showing the principal components of a ring spinning machine embodying our invention.

In FIG. 3 we have shown a ring spinning machine 10' with long feed rollers 31, 32, 33 representing respective stages of a draw frame through which rovings are delivered with progressive stretch to a set of spindles 37' as diagrammatically indicated by an arrow A. The counterrollers coacting with drawing rollers 31, 32 and 33 have not been illustrated. Each of these drawing rollers is driven by a respective motor 34, 35, 36 positively coupled therewith; some or all of these motors may also be duplicated at the far end of the respective rollers as described in our copending application Ser. No. 132,809 filed concurrently herewith. The three roller motors 34–36 are preferably all of the synchronous three-phase type energized from power line 50 via respective solid-state frequency inverters 42, 43, 44 under the control of digital frequency selectors 19*d*, 19*e*, 19*f* as described above. FIG. 3 also shows individual drive motors 14' for spindles 37' and a motor 13' for the reciprocation of a ring rail 30' traversed by these spindles. Motor 13' drives a leadscrew 39, coacting with a nut 41 on rail 30', through a reversing gear 40 which may be actuated by nonillustrated limit switches or by a timer to change the direction of screw rotation at the end of each vertical rail stroke. Motors 13' and 14', which are also preferably of the synchronous type, are energized from supply line 50 by way of respective solid-state frequency inverters 16' and 17' under the control of associated digital frequency selectors 19*g* and 19*h*.

The speed of motor 36, which drives the roller 33 forming part of the output stage of the draw frame, can be independently controlled with the aid of selector 19*f* whose signal source 20 (cf. FIG. 2) may be a free-running pulse generator as in the system of FIG. 1. A pulse generator 45, driven by motor 36 via a gear transmission 46, serves as the signal source for all other frequency selectors 19*d*, 19*e*, 19*g* and 19*h* whose respective motors 34, 35, 13' and 14' are thus slaved to master motor 36. While this master motor could also be an induction motor, with possible replacement of inverter 44 by a different frequency changer, the use of synchronous motors and digitally settable frequency inverters is particularly important for the remaining stages of the draw frame all of whose rollers must maintain a predetermined speed ratio.

It will be apparent that the power line 50 of FIGS. 1 and 3 need not be a three-phase network since the inverters connected thereto operate on direct current.

Our improved driving assembly shown in FIG. 1 or FIG. 3 can be easily adjusted, even by unskilled operators, to provide a wide variety of absolute and relative speeds of all its components.

We claim:

1. In a textile machine provided with a ring rail, a bank of parallel spindles traversing said ring rail, feed means for supplying filamentary materials to said spindles, first a-c motor means for reciprocating said ring rail along the axes of said spindles, second a-c motor means for rotating said spindles about their axes, and third a-c motor means for driving said feed means, the combination therewith of:

a power supply;

a first adjustable frequency changer inserted between said power supply and said first motor means;

a second adjustable frequency changer inserted between said power supply and said second motor means;

a third adjustable frequency changer inserted between said power supply and said third motor means;

first, second and third frequency selectors respectively connected to said first, second and third frequency changers for independently varying the frequency of an alternating current fed thereby to said first, second and third motor means, respectively; and a pulse generator in the form of a free-running oscillator delivering identical timing signals to said first, second and third frequency selectors.

2. The combination defined in claim 1 wherein said oscillator is adjustable.

3. The combination defined in claim 1 or 2, further comprising a programmer connected to said first frequency selector for varying in a predetermined manner the rate of displacement of said ring rail within a recurrent cycle of reciprocation.

4. In a textile machine, in combination:

a ring rail;

a bank of parallel spindles traversing said ring rail;

feed means for supplying filamentary material to said spindles;

a plurality of alternating-current motors constituting first motor means for reciprocating said ring rail along the axes of said spindles, second motor means for rotating said spindles about their axes and third motor means for driving said feed means, one of said motors being a master motor provided with speed-adjusting means;

a power supply connected to all said motors for energizing same;

a plurality of adjustable frequency changers respectively inserted between said power supply and all said motors other than said master motor;

a plurality of frequency selectors respectively connected to said frequency changers for independently varying the frequency of an alternating current fed thereby to the associated motors for varying their individual speeds; and a pulse generator driven by said master motor delivering identical timing signals to all said frequency selectors.

5. The combination defined in claim 4 wherein said feed means comprises a plurality of rollers forming several stages of a draw frame, said third motor means including respective motors for rotating each of said rollers.

6. The combination defined in claim 5 wherein said master motor is one of the motors of said third motor means.

7. The combination defined in claim 1, 2, 4, 5 or 6 wherein each of said frequency changers comprises a solid-state inverter with electronic switch means for a staggered energization of three phase leads, each of said frequency selectors comprising a digitally settable frequency divider connected to said pulse generator and pulse-distributing means connected to said divider for operating the electronic switch means in the associated frequency changer.

8. The combination defined in claim 7 wherein each of said frequency-selectors means further comprises a frequency multiplier inserted between said source and said frequency divider.

9. The combination defined in claim 7 wherein said first, second and third motor means are constituted by synchronous motors.

* * * * *